US006860133B2

(12) United States Patent
Kobayashi

(10) Patent No.: US 6,860,133 B2
(45) Date of Patent: Mar. 1, 2005

(54) PLATE MATERIAL PROCESSING MACHINE WITH BENDING FUNCTION AND TOOL FOR THE SAME

(75) Inventor: Hiroshi Kobayashi, Kani (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 10/368,576

(22) Filed: Feb. 20, 2003

(65) Prior Publication Data

US 2003/0154759 A1 Aug. 21, 2003

(30) Foreign Application Priority Data

Feb. 21, 2002 (JP) ..... 2002-044151
Oct. 21, 2002 (JP) ..... 2002-306232

(51) Int. Cl.[7] ..... B21D 5/04
(52) U.S. Cl. ..... 72/313; 72/388
(58) Field of Search ..... 72/306, 313–315, 72/387, 388, 422; 29/243.58

(56) References Cited

U.S. PATENT DOCUMENTS 2,569,181 A * 9/1951 Laxo ..... 72/312
3,987,740 A * 10/1976 Merson ..... 29/243.58
4,002,049 A * 1/1977 Randolph, Sr. ..... 72/388
4,365,500 A * 12/1982 Klukow ..... 72/387
4,520,646 A * 6/1985 Pauzin ..... 72/313
4,945,748 A * 8/1990 Worship et al. ..... 72/323
5,345,806 A * 9/1994 Sartorio et al. ..... 72/422
6,065,324 A * 5/2000 Russell ..... 72/387

FOREIGN PATENT DOCUMENTS

JP 224117 * 9/1989 ..... 72/313
JP 80123 * 3/1990 ..... 72/312
JP 175025 * 7/1990 ..... 72/313
JP 5-49132 6/1993

* cited by examiner

*Primary Examiner*—Daniel C. Crane
(74) *Attorney, Agent, or Firm*—Westerman, Hattori, Daniels & Adrian, LLP

(57) ABSTRACT

The present invention provides a plate material processing machine with a bending function which enables even a bending piece with two or more bending portions to be bent and which enables materials to be bend so as to have different bending directions, dimensions, angles, or the like using the same tools. An upper tool 21 and a lower tool 22 are provided which fix a plate material W by sandwiching it between themselves. An upper tool-side bending tool 23 and a lower tool-side bending tool 24 are provided on sides of the upper tool 21 and lower tool 22, respectively, so as to elevate and lower freely. The upper tool-side bending tool 23 and the lower tool-side bending tool 24 perform elevating and lowering operations relative to the upper tool 21 and the lower tool 22 to bend a plate material piece Wa of a plate material W sandwiched between the upper tool 21 and the lower tool 22. A plate material feeding mechanism adjusts the length over which the plate material piece Wa projects from the upper tool 21 and lower tool 22.

3 Claims, 15 Drawing Sheets

PLATE MATERIAL PROCESSING MACHINE WITH BENDING FUNCTION AND TOOL FOR THE SAME

FIELD OF THE INVENTION

The present invention relates to a plate material processing machine with a bending function such as a punch press, a laser processing machine, or a punch and laser composite machine which has a processing function of bending a plate material piece upward and downward, as well as a tool used for this plate material processing machine.

BACKGROUND OF THE INVENTION

Some conventional punch presses such as turret punch presses are provided with a forming tool instead of a punching tool to enable various forming operations such as burring and louvering.

The above-mentioned conventional punch press is disclosed, for example, in the Examined Japanese Patent Application Publication (Tokkou-Hei Number 7-85816).

However, the forming tool in the conventional punch press can provide only a specified shape and size. It cannot provide different bending sizes or angles even when processed materials have similar shapes. For example, if bending pieces that project in L form are to be produced, they cannot be processed to have different bending dimensions, i.e. different lengths of each side of the L form, or different bending angles for each side. Thus, even if bending pieces with similar shapes are to be produced, different tools must be used for the respective forming shapes with different bending dimensions or angles. Accordingly, if processed materials have various bending dimensions or angles, a large number of tools must be used. Consequently, tool change operations are required in order to change the tool installed in tool supporting means such as a turret.

If the bending pieces have such a simple shape that they have only to be bent at their proximal end, different bending dimensions or angles can be provided by adjusting feed rate or the like. However, if the bending piece must be processed to have an L shape or another having two or more bending portions, then this processing cannot be achieved.

It is an object of the present invention to provide a plate material processing machine with a bending function which enables even a bending piece with two or more bending portions to be bent and which enables materials to be bend so as to have different bending directions, dimensions, angles, or the like using the same tools.

It is another object of the present invention to provide a tool used to bend a plate material and having a simple configuration, the tool enabling materials to be bent so as to form different bending angles or acute angles.

It is still another object of the present invention to provide a sandwiching tool used to bend a plate material and having a simple configuration, the sandwiching tool enabling materials to be bent so as to form acute angles.

SUMMARY OF THE INVENTION

A plate material processing machine with a bending function according to the present invention comprises an upper tool and a lower tool that fix a plate material at a plate material placement level so as to sandwich the plate material between the upper tool and the lower tool, a plate material feeding mechanism that feeds, at the plate material placement level, the plate material in a predetermined plate material feeding direction to project a plate material piece projecting from the plate material, from an edge of the upper tool or lower tool to a downstream side in the plate material feeding direction; an upper tool-side bending tool provided in the upper tool so as to elevate and lower freely and performing a lowering operation to bend a bending proximal end of the plate material piece downward; and a lower tool-side bending tool provided in the upper tool so as to elevate and lower freely and performing an elevating operation to bend a bending proximal end of the plate material piece upward.

In this configuration, the plate material as a raw material is fixed so as to be sandwiched between the upper tool and the lower tool. In this sandwiched state, when the upper tool-side bending tool is lowered relative to the upper tool, the plate material piece of the plate material which projects from the edge of the lower tool is pushed and bent downward by the upper tool-side bending tool. In the sandwiched state, if the lower tool-side bending tool is elevated relative to the lower tool, the plate material piece is bent upward. In this manner, the plate material can be bent either upward or downward. After being bent either upward or downward, the plate material can be bent so as to have an L shape with two bending portions by using the plate material feeding mechanism to feed the plate material to change the position of its bending proximal end and then bending the plate material downward or upward, respectively. The plate material can be bent so as to have a U shape by repeating a bending operation of changing the position of the bending proximal end with the bending direction remaining unchanged. Further, the bending dimension can be changed by changing plate material feed rate so as to change the position of the bending proximal end. The bending angle can be changed by changing the amount by which the upper tool-side bending tool or the lower tool-side bending tool is elevated or lowered. In this manner, a bending piece with two or more bending portions can be produced using a single tool. Further, bending pieces with different bending dimensions or angles can be provided. Alternatively, the bending angle may be kept fixed by fixing the amount by which the upper tool-side bending tool or the lower tool-side bending tool is elevated or lowered.

In the present invention, the upper tool and the lower tool are rotatable around a common axis of rotation in a vertical direction. The upper tool-side bending tool and lower tool-side bending tool are arranged at sides of the upper tool and lower tool, respectively, and located opposite each other in the place material feeding direction relative to the upper tool and the lower tool, so as to be used for bending. A bending piece detouring space may be provided at a side of each of the upper tool and lower tool at which the upper tool-side bending tool or lower tool-side bending tool, respectively, is not arranged, so as to detour the bent place material piece to this space.

With this configuration, the upper and lower sides of the plate material can be sequentially bent by feeding the plate material in the same direction and rotating the upper tool and the lower tool. This enables the production of a bending piece with two or more bending portions such as an L-shaped bending piece or a bending piece with bending portions with different bending directions. Since a bending piece with two or more bending portions can be produced by feeding the plate material in the same direction, it is unnecessary to perform complicated operations such as rotation of the plate material around the tool. Consequently, it is possible to use a plate material feeding mechanism with a simple configuration. Further, since the plate material is sequentially bent upward and downward, the plate material piece can be placed at a position above the die height. This prevents the feeding of the plate material from being hindered after the bending operation. The bending piece detouring space serves to prevent the bent plate material piece from interfering with the upper tool or the lower tool. Therefore, the bending operation can be performed with a high degree of freedom.

If the upper tool and the lower tool are thus rotatable, the lower tool may have a sandwiching tool portion having a top surface as a plate material sandwiching surface and a plate material supporting table portion having a top surface that substantially constitutes the plate material placement level, the plate material supporting table portion being separated from the sandwiching tool portion. Further, the lower tool-side bending piece detouring space may be provided between the sandwiching tool portion and the plate material supporting table portion. Alternatively, the lower tool-side bending piece detouring space may be formed around the sandwiching tool portion of the lower tool so as to be annular. If this bending piece is annular, the lower tool can be rotated while the plate material piece bent downward remains in the lower tool-side bending piece detouring space. This allows the operation to be performed efficiently.

The upper tool-side bending tool and the lower tool-side bending tool may be elevated and lowered by tool elevation and lowering driving means that can switch between elevation and lowering before the bottom or top dead center of an elevating and lowering stroke is reached. This allows the bending angle to be adjusted easily. The elevation and lowering driving means for the upper tool-side bending tool may transmit driving via a punching ram.

A tool as a bending tool (63, 64 (corresponding to the embodiment in FIG. 12)) according to the present invention is the bending tool used to bend a plate material and having a pivoting support point portion arranged at one end and pivotably supporting the entire bending tool, a bending edge arranged at the other end and pushed against the plate material, and guide projections arranged on one and the other sides of the bending tool, respectively, in a pivoting direction around the pivoting support point portion and contacting with means for regulating the pivoting angle of the bending tool. The pivoting support point portion may be composed of, for example, a through-hole or a concave, or a projecting portion like a shaft. The bending edge may be shaped to have a round cross section such as a circular arc.

The bending tool of this configuration has the pivoting support point portion at one end and the guide projections on its opposite sides in the pivoting direction. Thus, when the bending tool is moved up or down relative to the plate material while being supported at the pivoting support point portion, the guide projections move up or down while slidably contacting with the angle regulating means. Accordingly, the angle of the bending tool is regulated. This enables plate materials to be bent so as to form different bending angles, particularly, acute angles. Further, in order to allow for spring-back of the plate material, the plate material can be bent so as to form an acute angle during processing so that a right angle can be maintained even after tool releasing. Furthermore, the bending tool is provided with the guide projections as areas that contact with the angle regulating means. Thus, as opposed to the simple use of flat end surfaces as areas that contact with the angle regulating means, it is easier to freely design the range to which a pivoting angle, and the like is limited. Further, the tool can be configured easily.

This bending tool may be used as either the upper tool-side bending tool or lower tool-side bending tool of the plate material processing machine with a bending function according to the present invention.

A tool as a sandwiching tool (27, 28 (corresponding to the embodiment in FIG. 12)) according to the present invention is the sandwiching tool as one of a pair of sandwiching tools which is used in bending a plate material and which sandwiches a plate material between opposite surfaces, the sandwiching tool having a sandwiching surface that contacts with the plate material, a guide surface separated from the sandwiching surface and lying substantially perpendicularly to the sandwiching surface, and a detouring surface which is provided between the guide surface and the sandwiching surface and which is more concave than the guide surface. A bending tool moving closer to and away from a surface of the plate material slidably contacts with the guide surface and has its position regulated. The detouring surface serves to avoid regulating the position of the bending tool.

The sandwiching tools of this configuration do not only enable the plate material to be sandwiched between themselves but also enable the position of the bending tool to be guided along the guide surface. At this time, the bending tool is guided along the guide surface to move up or down substantially perpendicularly to a surface of the plate material. Then, the regulation of position of the bending tool is cleared because of the presence of the detouring surface that is more concave than the guide surface. This enables the bending tool to perform certain operations without being obstructed by the sandwiching tool; the bending tool can be inclined toward the center of the sandwiching tools. Accordingly, the plate material can be bent so as to form an acute angle or so as to form a right angle to allow for the spring-back. Further, since the sandwiching tool is provided with the guide surface that guides the bending tool, no exclusive guide members are required. The entire tool including the sandwiching tool, the bending tool, and others can be configured easily.

This sandwiching tool is combined with, for example, the plate-material-bending bending tool of the present invention. In this case, the guide projection on one side of the bending tool is guided along the guide surface of the sandwiching tool. On the other hand, the guide projection on the other side of the bending tool is guided by a guide member different from that of the sandwiching tool. The bending tools, the sandwiching tool, and the guide projections may be configured as a set of assembly tools.

DETAILED DESCRIPTION OF THE PREFERRED EMBODIMENTS

Figure 1:
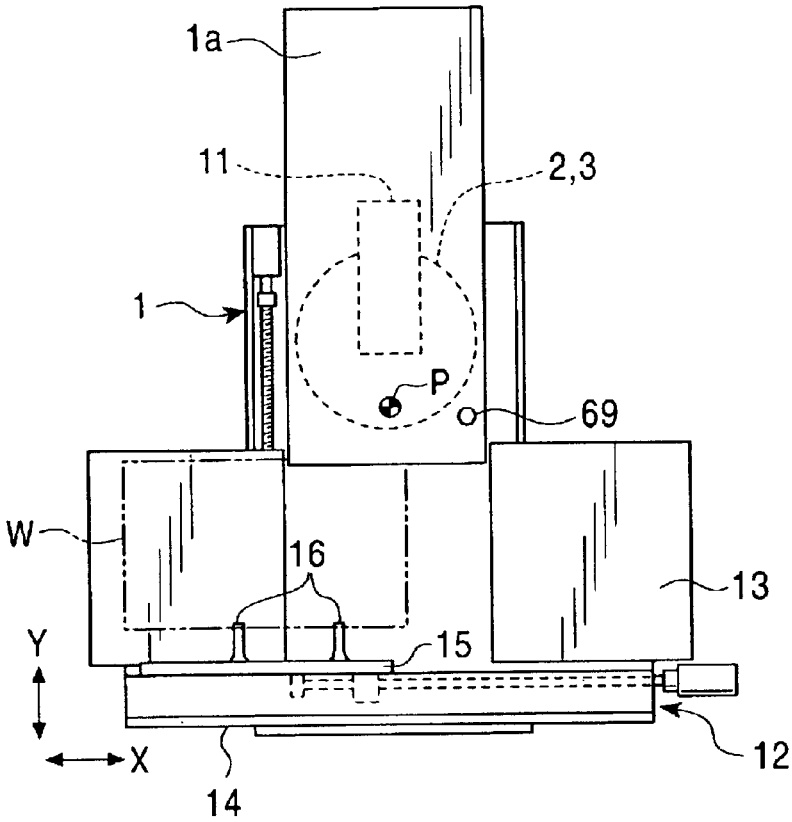
FIG. 1 is a plan view schematically showing a configuration of a plate material processing machine with a bending function according to an embodiment of the present invention.
Figure 2:
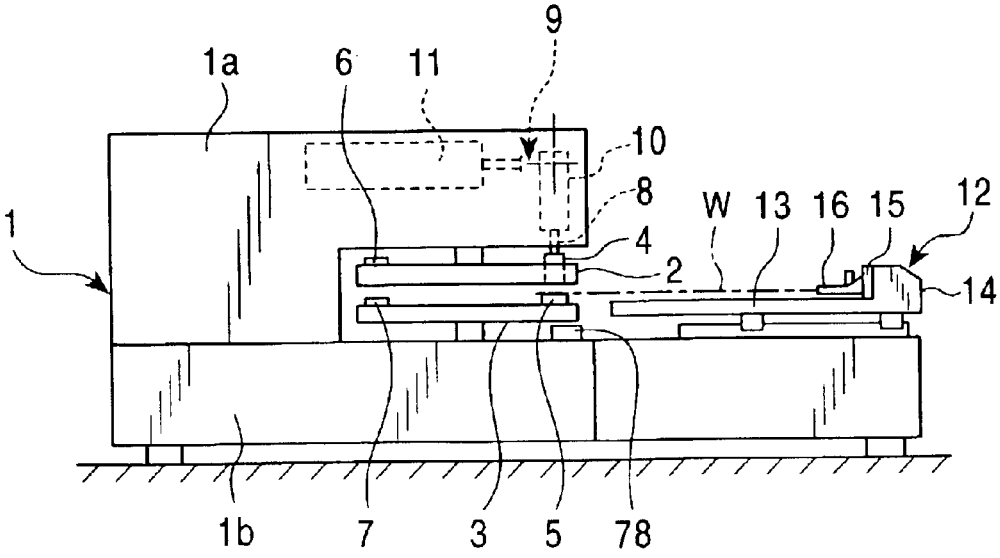
FIG. 2 is a side view schematically showing the configuration of this punch press.

A first embodiment of the present invention will be described with reference to FIGS. 1 to 7. FIG. 1 is a plan view schematically showing a configuration of a plate material processing machine with a bending function. FIG. 2 is a side view of this configuration.

This plate material processing machine is a punch press. An upper and lower tool supports 2, 3 composed of turrets are supported on an upper frame portion 1*a* and a lower frame portion 1*b*, respectively, of a frame 1 so as to be concentrically rotatable around a vertical axis. The upper and lower tool supports 2, 3 have a plurality of punches 4 and dies 5, respectively, and an upper and lower assembly tools 6, 7 for bending, respectively, all arranged in a circumferential direction. The upper and lower assembly tools 6, 7 for bending may each be provided at one position in the circumferential direction, or plural types of upper or lower assembly tools 6, 7 with different tool widths or the like may be provided at the respective positions. Each punch 4 and the upper assembly tool 8 for bending are driven by a ram 8 so as to elevate or lower while being indexed to a punch position P. The ram 8 is supported on the upper frame portion 1*a* via a guide member so as to elevate and lower freely. The ram 8 is driven to elevate and lower by a punch-side tool elevating and lowering means 9. The upper and lower tool supports 2, 3 are rotated synchronously via a transmission system such as a chain by a common motor (not shown in the drawings) installed in the frame 1. The motor and the transmission system index the desired tool to the punch position P. The punch-side tool elevating and lowering means 9 is composed of a crank mechanism 10 that drives the ram 8 to elevate and lower it and a driving source 11 such as a motor which rotates the crank mechanism 10.

A plate material feeding mechanism 12 is means for feeding an arbitrary portion of a plate material W placed on a table 13 to the punch position P. The plate material feeding mechanism 12 comprises a carriage 14 that moves forward and backward (Y direction), a cross slide 15 installed on the carriage 14 and moving in a lateral direction (X direction), and a work holder 16 attached to the cross slide 15 to grip an end of the plate material W.

As shown in FIG. 1, this plate material processing machine may be provided with a tap device 69. The tap device 69 is installed on the upper frame portion 1*a* of the frame 1, for example, at the side of the punch position P.

Figure 3:
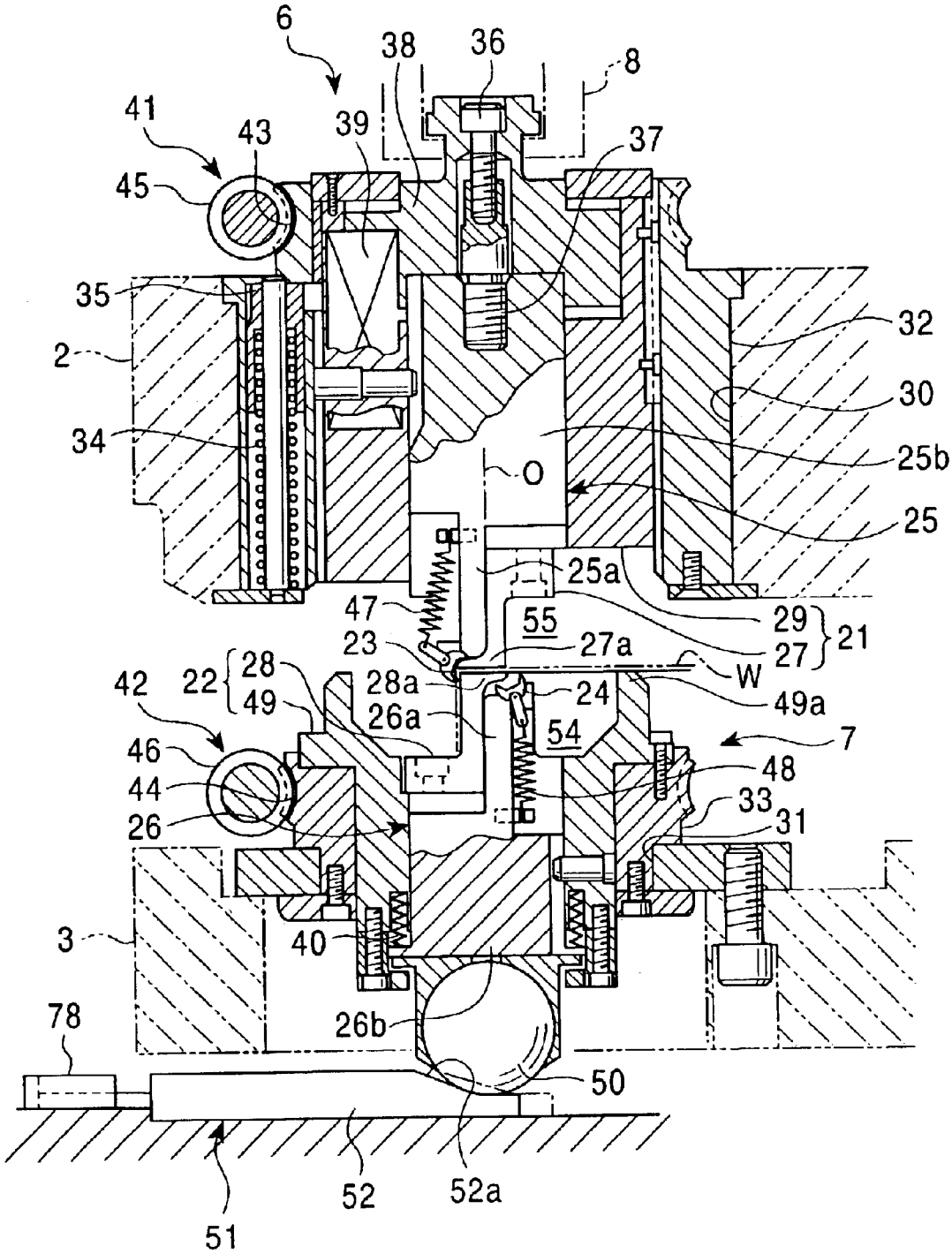
FIG. 3 is a vertical sectional view showing how bending assembly tools of the punch press is installed.
Figure 4:
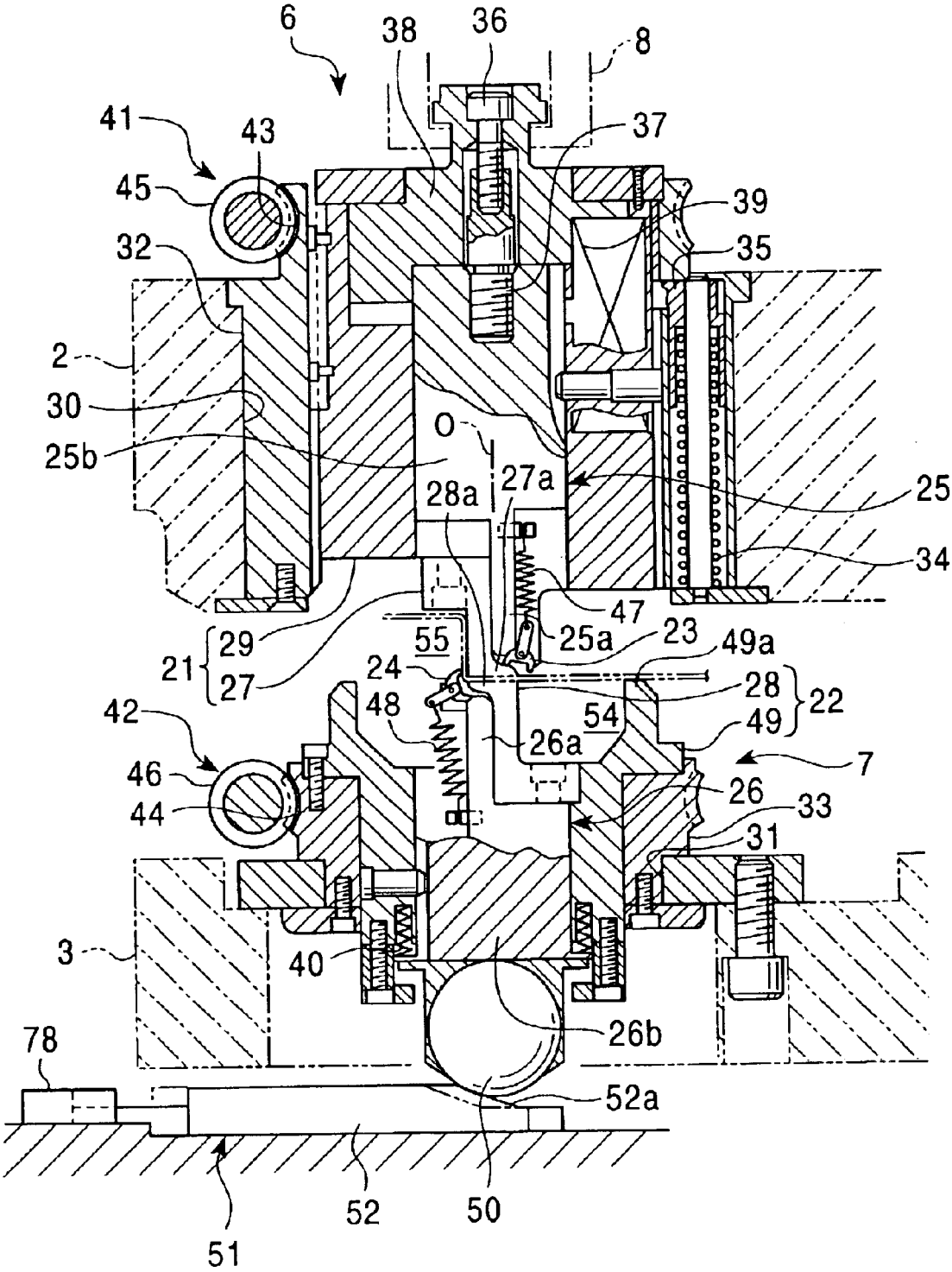
FIG. 4 is a vertical sectional view showing how the positions of the assembly tools are switched.

FIGS. 3 and 4 are vertical sectional views of bending assembly tools 6, 7 attached to the upper and lower tool supports 2, 3, respectively. The upper and lower assembly tools 6, 7 are used to bent the plate material W. The upper assembly tool 6 has an upper tool 21, an upper tool-side bending tool 23, and a lower-bending tool driving member 26. The lower assembly tool 7 has a lower tool 22, a lower tool-side bending tool 24, and a lower-bending tool driving member 26. The upper tool 21 and the lower tool 22 are members that fix the plate material W at the plate material placement level by sandwiching it between themselves. The upper tool 21 is composed of a sandwiching tool 27 having a sandwiching tool portion 27*a* with a bottom surface acting as a sandwiching surface for the plate material W and a guide member 29 to which the sandwiching tool 27 is fixed at its lower end and which is shaped generally like a cylinder. The guide member 29 is installed so as to freely elevate from and lower into a tool holder 32 supported rotatably in a tool installation hole 30 in the upper tool support 2 and so as to rotate integrally with the tool holder 32. Further, the guide member 29 is engaged with a support 35 urged upward by a spring 34 provided in the tool holder 32 to prevent the upper tool 21 from slipping out of the tool holder 32. The spring 34 has a smaller spring constant than a presser spring 39, described later.

The upper tool-side bending tool 23 is provided in the upper tool 21 so as to elevate and lower freely. It performs a lowering operation to bend a bending proximal end of a plate material piece Wa (FIG. 5) projecting from the plate material W. The upper tool-side bending tool 23 is arranged at one side of the sandwiching tool 27. The upper-bending tool driving member 25 for the upper assembly tool 6 lowers the upper tool-side bending tool 23. It has an acting portion 25*a* arranged along the above side of the sandwiching tool 27 and a base portion 25*b* located above the acting portion 25*a*. The base portion 25*b* is supported so as to freely elevate from and lower into the guide member 29 of the upper tool 21 and so as to rotate integrally with the guide member 29. Further, the base portion 25*b* of the upper-bending tool driving member 25 is attached to an upper supporting member 38 using set bolts 36, 37. The supporting member 38 is driven by the ram 8 of the punch-side tool elevating and lowering means 9 so as to elevate and lower. It is driven to elevate and lower by engaging its T-shaped head portion with the ram 8. The supporting member 38 is urged upward relative to the guide member 29 of the upper tool 21 by the presser spring 39. The tool holder 32 is rotationally driven by a rotating mechanism 41 installed in the upper tool support 2. The rotating mechanism 41 is composed of a worm 45 that engages with a worm wheel 43 in the tool holder 32, a motor (not shown in the drawings) that rotationally drives the worm 45, and others. Thus, the rotating mechanism 41 drives the upper assembly tool 6 so as to rotate integrally with the tool holder 32.

Figure 5A:
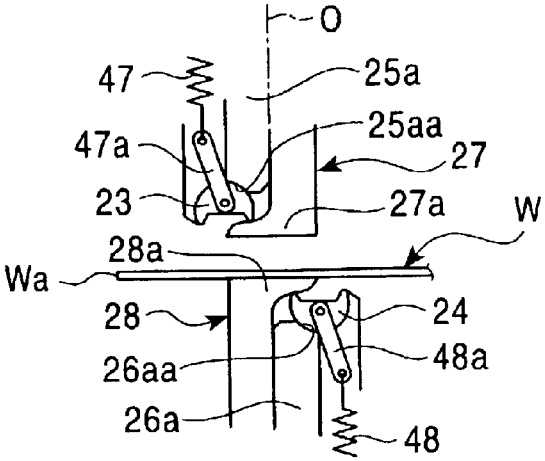
FIG. 5 is a diagram illustrating the former half of a bending process using the punch press.

The upper tool-side bending tool 23 of the upper assembly tool 6 is a member having a crescent cross section as shown in an enlarged view in FIG. 5A. It is pivotably arranged at the lower end of the acting portion 25*a* of the upper-bending tool driving member 25 with its concave surface directed downward. That is, the lower end of the acting portion 25*a* constitutes a concave surface 25*aa* shaped like a cylindrical surface so as to correspond to a convex surface of the upper tool-side bending tool 23. The convex surface of the upper tool-side bending tool 23 slidably contacts with the concave surface 25*aa* to allow the upper tool-side bending tool 23 to pivot freely. One end of the upper tool-side bending tool 23 is received by the top surface of laterally raised portion of the sandwiching tool portion 27*a*. An intermediate portion of the upper tool-side bending tool 23 is urged upward by a spring 47 having one end connected to the proximal end of the acting portion 25*a*. The spring 47 is connected to the upper tool-side bending tool 23 via a spring receiving arm 47*a* projecting obliquely upward from the upper tool-side bending tool 23 and opposite the sandwiching tool portion 27*a*. Thus, when the upper tool-side bending tool 23 is pushed down by the upper-bending tool driving member 25 to lower relative to the sandwiching tool portion 27*a*, the upper tool-side bending tool 23 is pivoted in a direction in which the other side of the upper tool-side bending tool 23 lowers, which is not received by the sandwiching tool portion 27*a* of the sandwiching tool 27. The plate material W is thus bent.

As shown in FIG. 3, the lower tool 22 is composed of a sandwiching tool 28 having a sandwiching tool portion 28*a* with a top surface acting as a sandwiching surface for the plate material W and a guide member 49 to which the sandwiching tool 28 is fixed at its upper end and which is shaped generally like a cylinder. The guide member 49 is fixed in a tool holder 33 supported rotatably in a tool installation hole 31 in the lower tool support 3.

The lower tool-side bending tool 24 is provided in the lower tool 22 so as to elevate and lower freely. It performs an elevating operation to bend the bending proximal end of the plate material piece Wa projecting from the plate material W. The lower tool-side bending tool 24 is arranged at one side of the sandwiching tool 28. The lower-bending tool driving member 26 for the lower assembly tool 7 elevates the lower tool-side bending tool 24. It has an acting portion 26*a* arranged along the above side of the sandwiching tool 28 and a base portion 26*b* located above the acting portion 26*a*. The base portion 26*b* is supported so as to freely elevate from and lower into the guide member 49 of the lower tool 22 and so as to rotate integrally with the guide member 49. Further, a ball 50 is installed under the base portion 26*b* of the lower-bending tool driving member 26. The lower-bending tool driving member 26 is supported, via the ball 50, on die-side tool elevating lowering means 51 installed below the lower tool support 3. The die-side tool elevating and lowering means 51 is composed of an advancing and retreating member 52 having an inclined surface portion 52*a* and a driving source 78 used to advance and retreat the advancing and retreating member 52. The ball 50 is supported on the top surface of the advancing and retreating member 52. The lower-bending tool driving member 26 is urged by a presser spring 40 to lower relative to the guide member 49.

The lower tool holder 33 is rotationally driven by a rotating mechanism 42 installed in the lower tool support 3. The rotating mechanism 42 is composed of a worm 46 that engages with a worm wheel 44 in the lower tool holder 33, a motor (not shownin the drawings) that rotationally drives the worm 46, and others. Thus, the rotating mechanism 42 drives the lower assembly tool 7 so as to rotate integrally with the tool holder 33.

The lower tool-side bending tool 24 of the lower assembly tool 7 is a member having a crescent cross section as shown in an enlarged view in FIG. 5A. It is pivotably arranged at the lower end of the acting portion 26*a* of the lower-bending tool driving member 26 with its concave surface directed upward. That is, the upper end of the acting portion 26*a* constitutes a concave surface 26*aa* shaped like a cylindrical surface so as to correspond to a convex surface of the lower tool-side bending tool 24. The convex surface of the lower tool-side bending tool 24 slidably contacts with the concave surface 26*aa* to allow the lower tool-side bending tool 24 to pivot freely. One end of the lower tool bending tool 24 is received by the bottom surface of laterally raised portion of the sandwiching tool portion 28*a* of the sandwiching tool 28. An intermediate portion of the lower tool-side bending tool 24 is urged downward by a spring 48 having one end connected to the proximal end of the acting portion 26*a*. The spring 48 is connected to the lower tool-side bending tool 24 via a spring receiving arm 48*a* projecting obliquely downward from the lower tool-side bending tool 24 and opposite the sandwiching tool portion 28*a*. Thus, when the lower tool-side bending tool 24 is pushed down by the lower-bending tool driving member 26 to elevate relative to the sandwiching tool portion 28*a* of the sandwiching tool 28, the lower tool-side bending tool 24 is pivoted in a direction in which the other side of the lower tool-side bending tool 24 elevates, which is not received by the sandwiching tool portion 28*a* of the sandwiching tool 28. The plate material W is thus bent.

As shown in FIG. 3, a ring-like plate material supporting table portion 49*a* having a top surface constituting a plate material placement level is formed at the upper end of guide member 49 of the lower tool 22. The ring-like plate material supporting table portion 49*a* is concentric to the lower tool holder 33. It is formed away from the outer diameter of sandwiching tool portion 28*a* of the sandwiching tool 28. A bending piece detouring space 54 is formed between the sandwiching tool portion 28*a* and the plate material supporting table portion 49*a* so as to detour a bending piece to this space while the plate material W is being bent. Further, a bending piece detouring space 55 is formed at one side of the sandwiching tool 27 at which the upper tool-side bending tool 23 is not arranged, so as to detour the bending piece to this space while the plate material W is being bent.

The upper and lower tool holders 32, 33 are rotatable around a common axis of rotation 0. Accordingly, the upper tool 21 and the lower tool 22 are also rotatable around the axis of rotation 0. The sandwiching tools 27, 28 are arranged at the position of the axis of rotation. While the upper tool-side bending tool 23 is arranged at one side of the sandwiching tool 27, the lower tool-side bending tool 24 is arranged at a side of the sandwiching tool 28 which is opposite to the above side facing the upper tool-side bending tool 23.

Figure 7:
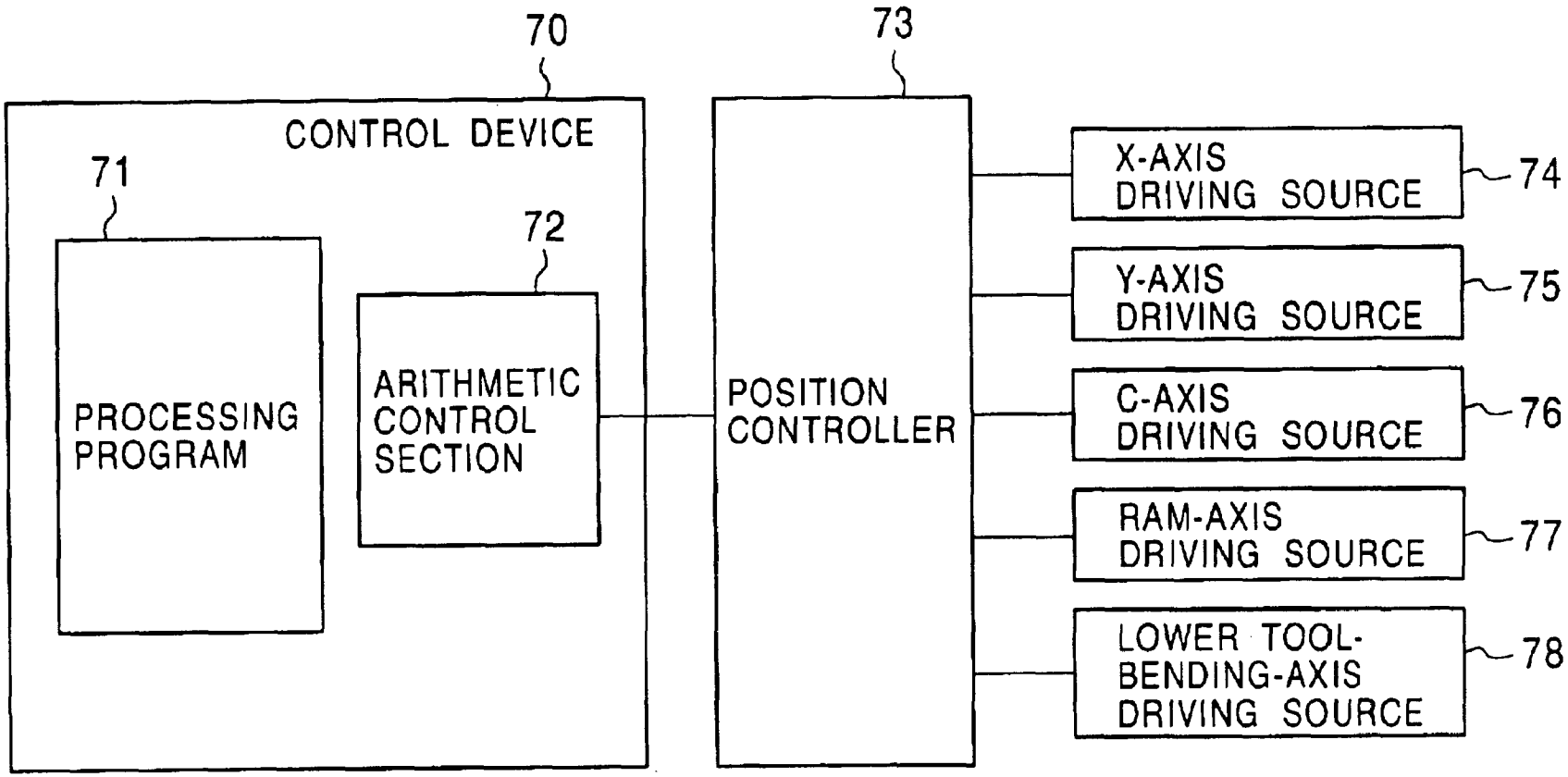
FIG. 7 is a block diagram showing a conceptual configuration of a control system for the plate material processing machine.

FIG. 7 is a block diagram showing a control system for this plate material processing machine. A control device 70 is means for controlling the entire plate material processing machine with a bending function. It is composed of a computer-based numerical control device and a programmable controller. The control device 70 controls driving on each axis carried out by driving sources 74 to 78, described later, by using an arithmetic control section 72 to execute movement commands (not shown in the drawings) for each axis in a processing program 71. The shaft driving sources 74 to 78 have the amount of their movements adjusted freely and are each composed of a servo motor. The X-axis driving source 74 and the Y-axis driving source 75 feed a plate material in each axial direction (X or Y direction) in the plate material feeding mechanism 12. The C-axis driving source 76 rotates the upper tool 21 and the lower tool 22 around the common axis of rotation in the vertical direction. It drives the rotating mechanisms 41, 42 (FIG. 3). The ram axis driving source 77 elevates and lowers the ram 8. The lower tool-side bending axis driving source 78 elevates and lowers the lower tool-side bending tool 24, and advances and retreats the advancing and retreating member 52 (FIG. 3).

The control device 70 controls these driving sources 74 to 78 via a position controller 73 or directly. The position controller 73 is means for adjusting movement timings for the driving sources 74 to 78 on the respective axes according to commands such as positional ones transmitted by the arithmetic control section 72 of the control device, and generating and transmitting drive commands to the driving sources 74 to 78 according to the movement timings.

The control device 70 causes sequence control commands (not shown in the drawings) in the processing program 71 to be executed by transferring them from the arithmetic control section 72 to the programmable controller section (not shown in the drawings).

Figure 5B:
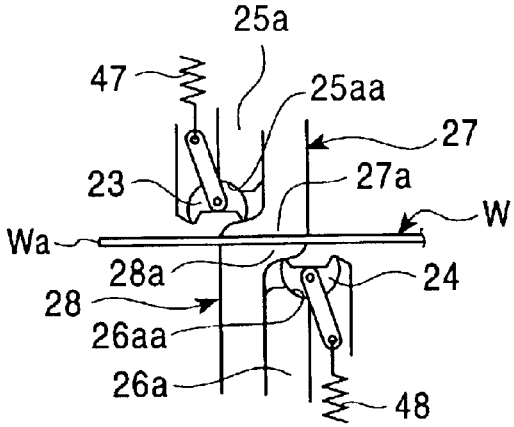
Figure 5C:
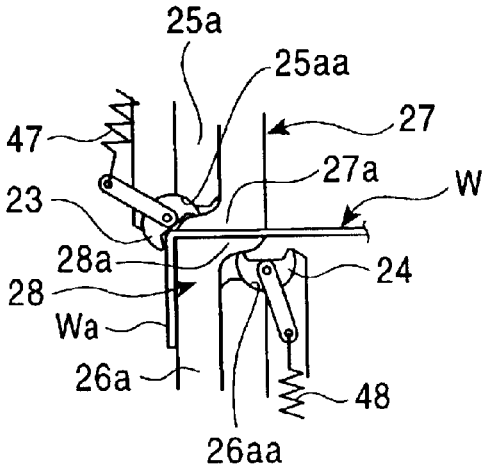
Figure 5D:
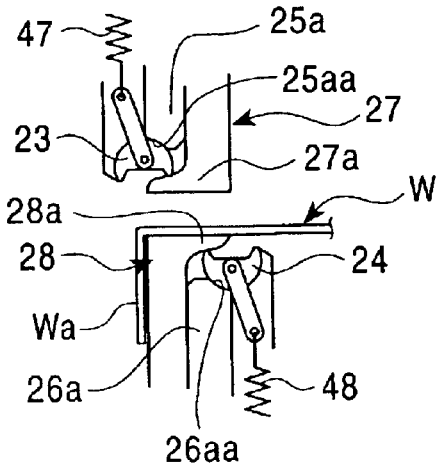
Figure 6A:
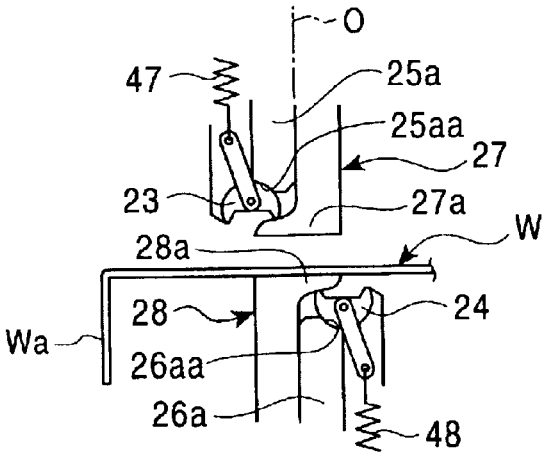
FIG. 6 is a diagram illustrating the latter half of the bending process using the punch press.
Figure 6B:
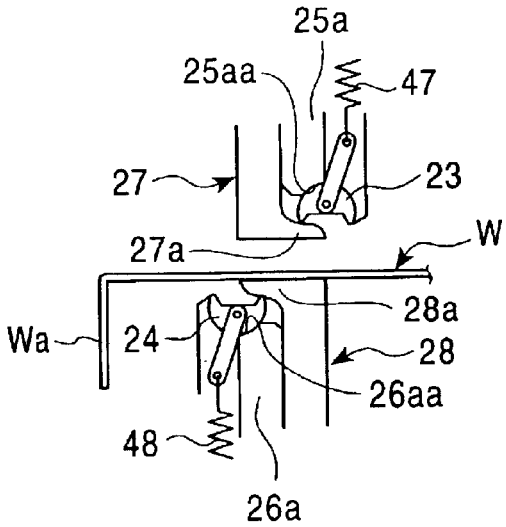
Figure 6C:
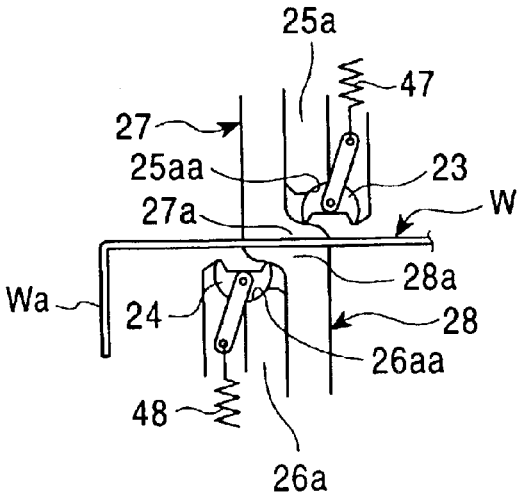
Figure 6D:
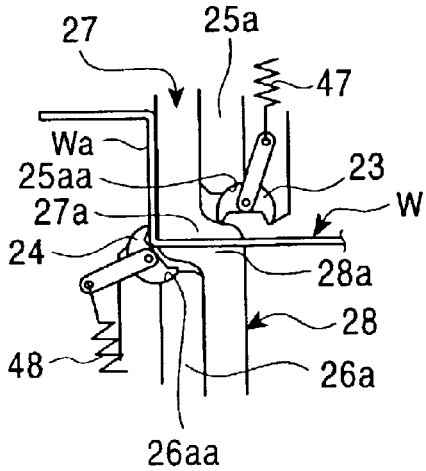
Figure 14A:
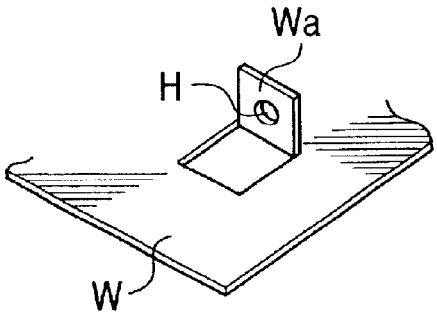
FIG. 14 is a perspective view showing various bending forms of a plate material piece bent by the plate material processing machine with a bending function according to the present invention.
Figure 14B:
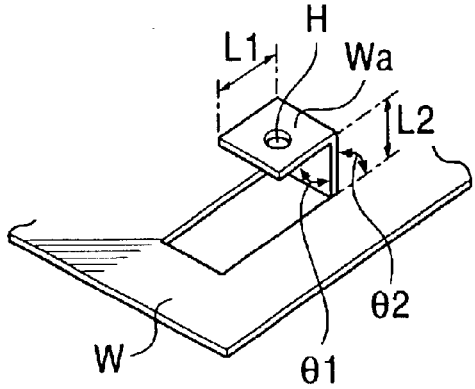

Now, with reference to FIGS. 5 and 6, description will be given of operations performed by the plate material processing machine of this embodiment to bend the plate material piece Wa projecting from the plate material W in L form in two steps as shown in FIGS. 6D and 14B.

In this bending operation, the upper and lower assembly tools 6, 7 installed in the tool supports 2, 3, respectively, are indexed to the punch position P. As shown in FIG. 5A, in the lower tool 22 of the lower assembly tool 7, the top surface of sandwiching tool portion 28*a* of the sandwiching tool 28 constitutes a plate material placement level. The lower tool-side bending tool 24 stands by slightly below the plate material placement level. That is, at this time, the ball 50 (FIG. 3), located at the lower end of the lower-bending tool driving member 26, rests on a flat surface located below the inclined surface portion 52*a* of the advancing and retreating member 52. The lower-bending tool driving member 26 has been lowered. In the upper tool 21 of the upper assembly tool 6, the bottom surface of sandwiching tool portion 27*a* of the sandwiching tool 27 has been retreated to a position slightly above the plate material placement level. At this time, the upper tool-side bending tool 23 has been retreated to a position above the bottom surface of sandwiching tool portion 27*a* of the sandwiching tool 27. In this state, the plate material feeding mechanism 12 (FIG. 1) feeds the bending portion of the plate material W to the punch position P. That is, the plate material W is fed so that the plate material piece Wa of the plate material. W projects beyond the sandwiching tool portion 28*a* of the sandwiching tool 28 to a side on which the upper tool-side bending tool 23 is positioned. The plate material piece Wa is a tongue piece formed by making a cut in the plate material so as to leave its proximal end around the plate material piece Wa. The plate material piece Wa is formed in the plate material W using, for example, another set of punch 4 and die 5 of the plate material processing machine with a bending function.

Then, the punch-side tool elevating and lowering means 9 drives and lowers the upper tool 21 together with the supporting member 38, engaged with the ram 8. As shown in FIG. 5B, the plate material W is sandwiched between the sandwiching tool portion 27*a* of the sandwiching tool 27 and the sandwiching tool portion 28*a* of the sandwiching tool 28.

As the punch-side tool elevating and lowering means 9 drives and lowers the upper-bending tool driving member 25 against the force of the presser spring 39. The acting portion 25*a* of the upper-bending tool driving member 25 pushes the upper tool-side bending tool 23 downward. Thus, the upper tool-side bending tool 23 is pivoted so that one end of it lowers as shown in FIG. 5C. Accordingly, the plate material piece Wa of the plate material W is bent downward. The plate material piece Wa is bent along the edge of top surface of the sandwiching tool portion 28*a* of the sandwiching tool 28.

Subsequently, the punch-side tool elevating and lowering means 9 drives and elevates the upper tool 21 together with the supporting member 38, engaged with the ram 8. Then, the bottom surface of sandwiching tool portion 27*a* of the sandwiching tool 27 is retreated to a position slightly above the plate material W as shown in FIG. 5D.

Then, as shown in FIG. 6A, the plate material feeding mechanism 12 (FIG. 1) further feeds the plate material piece Wa of the plate material W to the side on which the upper tool-side bending tool 23 is positioned, by a predetermined amount. Then, the upper and lower assembly dies 6, 7 are rotated through 180 degrees. That is, the upper and lower tool holders 32, 33 are rotationally driven by the corresponding rotating mechanisms 41, 42. Thus, as shown in FIG. 6B, in the upper assembly tool 6, the upper tool-side bending tool 23 is placed at the right side of the sandwiching tool 27. On the other hand, in the lower assembly tool 7, the lower tool-side bending tool 24 is placed at the left side of the sandwiching tool 28. FIG. 4 generally shows the state in which upper and lower assembly tools 6, 7 have thus been moved.

Then, the punch-side tool elevating and lowering means 9 drives and lowers the upper tool 21 together with the supporting member 38, engaged with the ram 8. As shown in FIG. 6C, the plate material W is sandwiched between the sandwiching tool portion 27*a* of the sandwiching tool 27 and the sandwiching tool portion 28*a* of the sandwiching tool 28.

Then, the die-side tool elevating and lowering means 51 carries out elevatory driving, i.e. the driving source 77 advances the advancing and retreating member 52. Thus, the ball 50, located at the lower end of the lower-bending tool driving member 26, runs onto the inclined surface portion 52*a* of the advancing and retreating member 52. The lower-bending tool driving member 26 elevates against the force of the presser spring 59. The acting portion 26*a* of the lower-bending tool driving member 26 pushes up the lower tool-side bending tool 24, which is thus pivoted so that one end of its elevates as shown in FIG. 6D. Thus, the bending proximal end of the plate material piece Wa of the plate material W which projects to a position at which it faces the lower tool-side bending tool 24 is bent upward. This allows the plate material to be bent in L form as shown in FIG. 14B, i.e. the plate material can have two bending portions extending in different bending directions.

When such a bending operation is performed, adjusting the feed rate for the plate material enables the bending lengths L1, L2 (FIG. 14B) of the bent plate material piece Wa to be adjusted freely. Further, portions with the bending lengths L1, L2 can be bent in various manners using a single set of dies. Further, the bending angles ($\theta 1$, $\theta 2$ of bending portions of the plate material piece Wa can be changed freely by adjusting the amount by which the upper tool-side bending tool 23 or the lower tool-side bending tool 24 is elevated and lowered during a bending operation. To allow the bending angles to be changed freely, the punch-side tool elevating and lowering means 9 and the die-side tool elevating and lowering means 51 must allow the adjustment of the amount by which they are elevated and lowered. For example, they must be mechanisms using, for example, a servo motor as a driving source. If the bending angles may be fixed, the configuration of the machine can be simplified by setting, at a fixed value, the amount by which the punch-side tool elevating and lowering means 9 and the die-side tool elevating and lowering means 51 elevated and lowered.

Figure 14C:
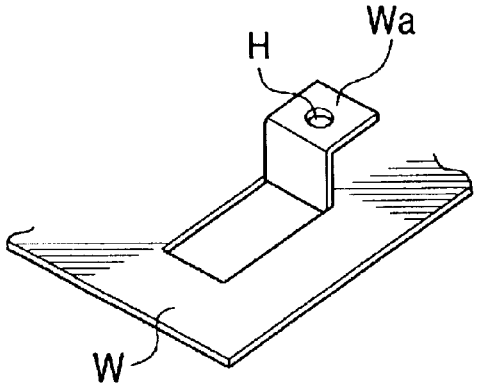
Figure 14D:
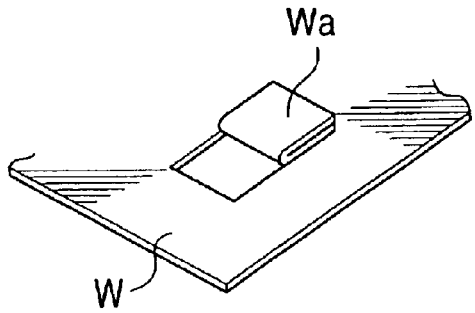

Further, this plate material processing machine with a bending function does not only enable the plate material to be bent in one direction as shown in FIG. 14B but also enables it to be bent in U form as shown in FIG. 14C or folded up as shown in FIG. 14D. The plate material can be folded up by using the upper tool-side bending tool 23 or the lower tool-side bending tool 24 to bend it so as to form an acute angle and then sandwiching it between the upper tool 21 and the lower tool 22. In this manner, various bending operations can be performed using a single set of tools.

As shown in FIGS. 14A to 14C, if a tap hole H is formed in the plate material piece Wa, then it is formed before bending the plate material piece Wa. For example, the tap hole H is formed by forming a bottom hole using an appropriate set of punch 4 and die 5 installed on the tool supports 2, 3 in FIG. 1, respectively and then using the tap device 69 to carry out tapping. The tapping operation may be performed before or after the plate material piece Wa that has not been bent yet is formed.

Figure 8:
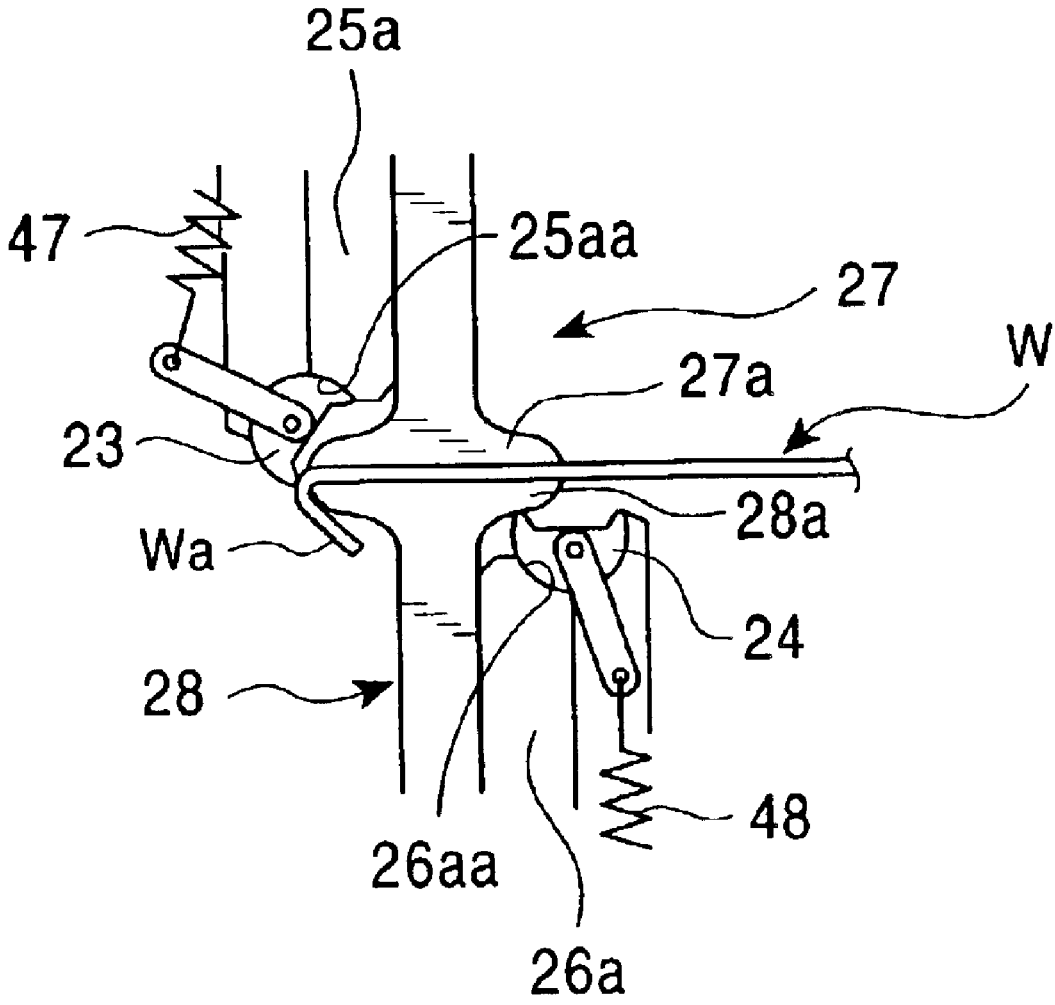
FIG. 8 is a side view showing a variation of an upper tool and a lower tool.
Figure 9:
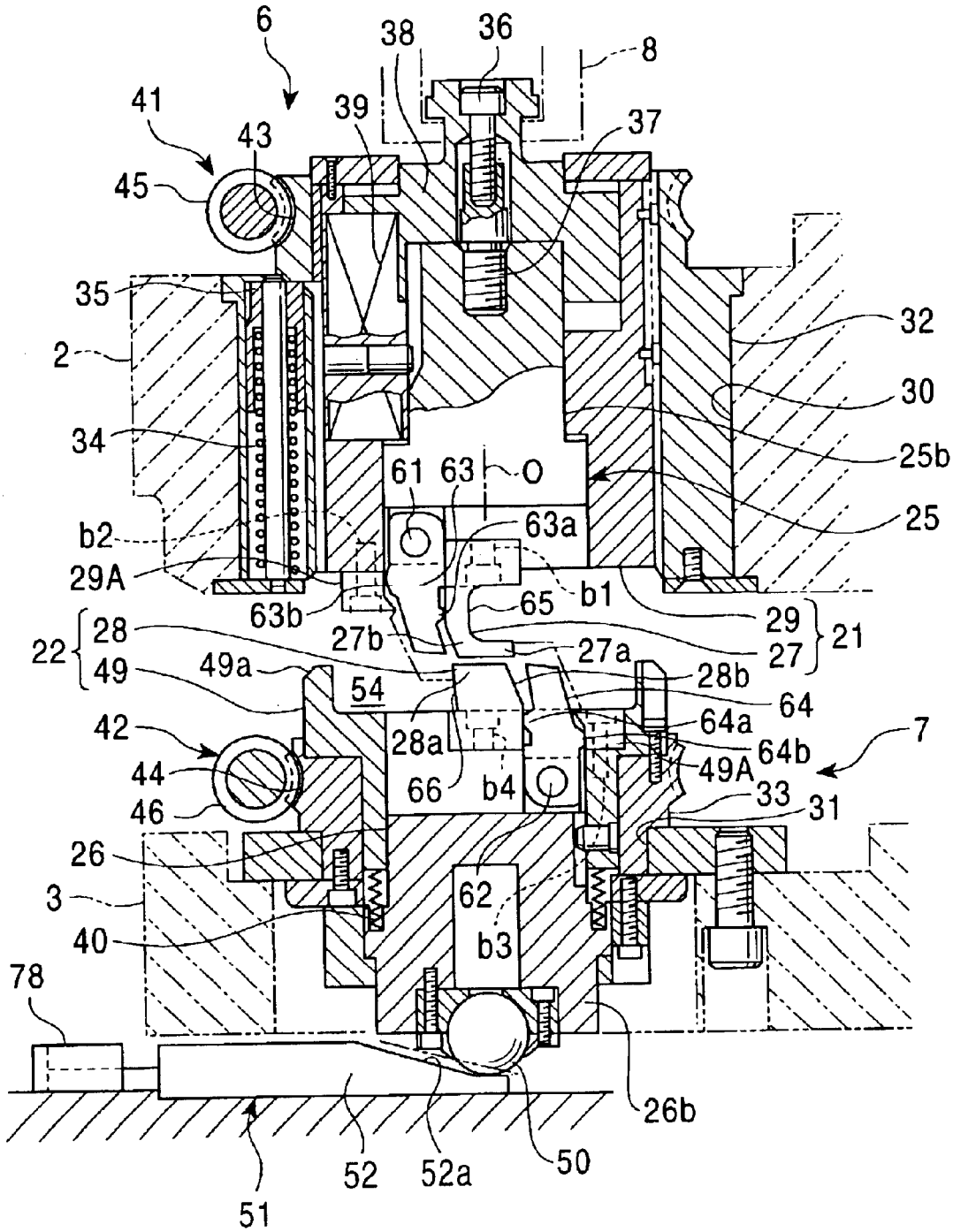
FIG. 9 is a vertical sectional view showing how bending assembly tools of a plate material processing machine with a bending function according to another embodiment of the present invention is installed.

In the above embodiment, the side of the sandwiching tool 28 which faces its side opposite to the lower tool-side bending tool 24 may be an inclined surface that is tapered downward as shown in FIG. 8. Thus, as shown in this figure, the plate material piece Wa can be bent so as to form an acute angle. Further, the side of the upper tool-side main body 27 which is opposite to its side facing the upper tool-side bending tool 23 may be an inclined surface that is tapered upward as shown in FIG. 8. Thus, if the plate material piece Wa is bent upward, it can be bent so as to form an acute angle.

FIGS. 9 to 13 show another embodiment. This embodiment uses the bending tool and sandwiching tool set forth in claims 4 and 5. This corresponds to the first embodiment wherein the upper and lower tool-side bending tools 23, 24 having a crescent cross section are replaced with bending tools 63, 64 like pawl pieces which are pivotably supported by supporting shafts 61, 62. A plate material processing machine with a bending function according to this embodiment differs from the first embodiment in that the bending tools 63, 64 have a configuration different from that of the sandwiching tools 27, 28. However, the other arrangements of this embodiment are the same as those of the first embodiment except for the points expressly described below. The punch-side tool elevating and lowering means 9 (FIG. 2), die-side tool elevating and lowering means 51 (FIG. 3), upper and lower-bending tool driving members 25, 26, upper and lower guide members 29, 49, tool holders 32, 33, and rotating mechanisms 41, 42, all of which constitute means for supporting and driving the bending tools 63, 64 or the sandwiching tools 27, 28, have the same configurations as those in the first embodiment except for the points expressly described below.

Figure 12A:
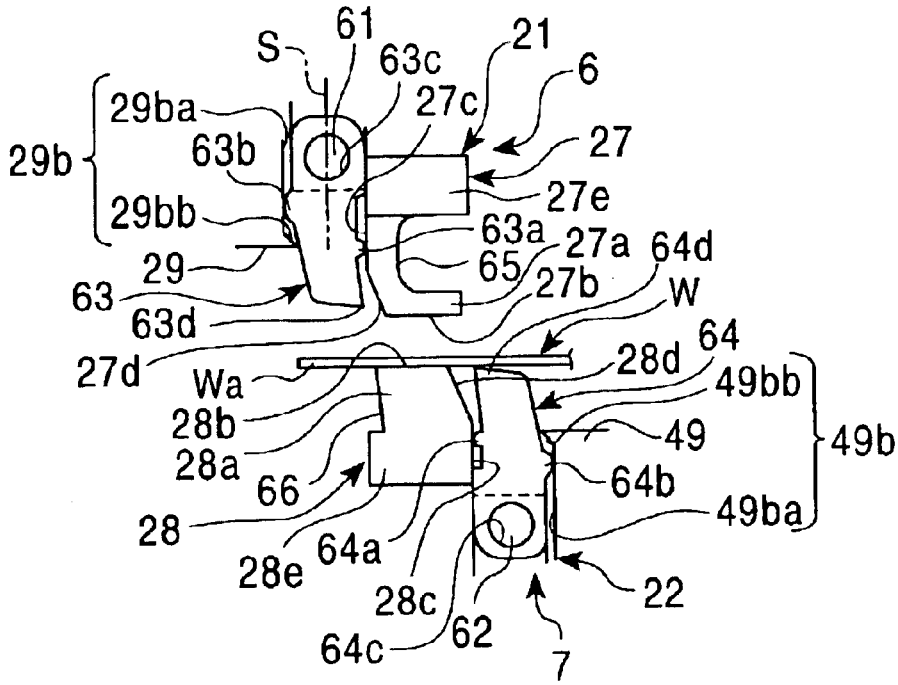
FIG. 12 is a diagram illustrating the former half of a bending process using the punch press.

As shown in FIG. 12A, the bending tool 63 of the upper tool 21 in this embodiment has a pivoting support point portion 63*c* arranged at its upper end to support the entire bending tool 63 so as to pivot freely and a bending edge 63*d* arranged at its lower end and pushed against the plate material piece W. The bending edge 63*d* is a tool portion at which the plate material W is bent. It may have an R shape, i.e. it may be a round portion having a circular cross section or the like. The pivoting support point portion 63*c* is composed of a hole with a circular cross section. The supporting shaft 61, provided in the upper-bending tool driving member 25 (FIG. 9), is fitted in the pivoting support point portion 63*c* so as to rotationally move freely. That is, the upper tool-side bending tool 63 has its upper end supported at the lower end of the upper-bending tool driving member 25 so as to pivot freely toward the side on which the sandwiching tool 27 is positioned. Further, the upper tool-side bending tool 63 has guide projections 63*a*, 63*b* formed on one and the other sides of it in a direction in which it pivots around the pivoting support point portion 63*c*. The guide projections 63*a*, 63*b* contact with guide surfaces 27*c*, 27*b* of the sandwiching tool 27 and guide member 29, respectively, which constitute means for regulating the pivoting angle of the bending tool 63. While the guide projections 63*a*, 63*b* are being guided along the guide surfaces 27*c*, 29*b* of the sandwiching tool 27 and guide member 29, respectively (in this state, the bending tool 63 is in a vertical state), the bending edge 63*d* of the bending tool 63 is located closer to the sandwiching tool 27 than a surface S which passes through the center of the pivoting support point portion 63*c* and which is parallel with the guide surface 27*c*.

The sandwiching tool 27 has the sandwiching surface 27*b*, which contacts with the plate material W, at its tip constituting a bottom surface. The guide surface 27*c* is provided on the side of the sandwiching tool 27 which faces the bending tool 63 and above the sandwiching surface 27*b*. A detouring surface 27*d* that is more concave than the guide surface 27*c* is provided between the guide surface 27*c* and the sandwiching surface 27*b*. The guide surface 27*c* is substantially perpendicular to the sandwiching surface 27*b*. The detouring surface 27*d* serves to avoid regulating the position of the bending tool 63. It is an inclined surface that is tapered downward. The detouring surface 27*d* need not necessarily be an inclined surface. For example, it may be concave like a notch.

A bending piece detouring space 65 is formed at the side of the sandwiching tool 27 which is opposite to its side facing the bending tool 63 so that a bending piece of the plate material W which is bent upward by the lower tool 22 can be detoured to this space. The bending piece detouring space 65 is formed of a concave portion like a groove extending in a tool width direction. The sandwiching tool portion 27*a*, on which the sandwiching surface 27*b* formed, is located below the bending piece detouring space 65. The sandwiching tool 27 has a base portion 27*e* arranged at its upper end and which is wider than its remaining part. The sandwiching tool 27 is removably fixed, at the base portion 27*e*, to the guide member 29 using fixtures b1 such as bolts. That is, the guide member 29 and the sandwiching tool 27 elevate and lower integrally. In the illustrated example, the base portion 27*e* extends linearly in the tool width direction. However, it may have an arbitrary shape such as a semicircle.

Figure 10:
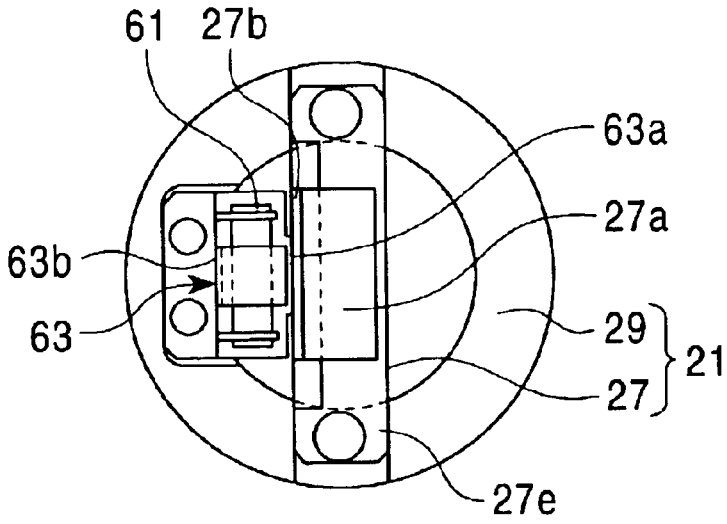
FIG. 10 is a bottom view of an upper tool of this punch press.

In FIG. 12A, the guide surface 29*b* of the guide member 29 is composed of a vertical surface portion 29*ba* parallel with the guide surface 27*c* of the sandwiching tool 27 and a ramp portion 29*bb* that approaches the sandwiching tool 27 as it extends downward from the lower end of the vertical surface portion 29*ba*. The ramp portion 29*ba* has only to be generally inclined and may be a curved surface. The ramp portion 29*bb* is formed at the position with which the guide projection 63*b* contacts after the guide projection 63*a* has reached the detouring surface 27*d* of the sandwiching tool 27 in response to the descent of the bending tool 63, or simultaneously with the arrival of the guide projection 63*a* at the detouring surface 27*d*. The guide member 29 is formed like a cylinder surrounding the sandwiching tool 27 and has the guide surface 29*b* formed at its bottom. Specifically, the guide surface 29*b* is formed on a guide piece 29A (FIG. 9) attached to the cylindrical guide member main body of the guide member 29 using fixtures b2 such as bolts. In addition, the guide member 29 supports the upper-bending tool driving member 25 inside so as to elevate and lower freely, as described in the first embodiment. FIG. 10 is a plan view of the upper tool 21 showing how the upper tool-side bending tool 63 as viewed from its bottom.

In FIG. 8, the lower tool 22 has a shape and configuration obtained by turning the upper tool 21 upside down except for the points expressly described below. The upper tool 21 and the lower tool 22 are such that the arrangement of the bending tool 63 with respect to the sandwiching tool 27 is obtained by inverting the arrangement of the bending tool 64 with respect to the sandwiching tool 28 through 180 degrees around the vertical axis of the sandwiching tools 27, 28, vice versa.

The points of the bending tool 64 of the lower tool 22 will be described with reference to FIG. 12A. The bending tool 64 has a pivoting support point portion 64*c* arranged at its lower end and supporting the entire bending tool 64 so as to pivot freely, a bending edge 64*d* arranged at its upper end and pushed against the plate material W, and guide projections 64*a*, 64*b* that contacts with the sandwiching tool 28, means for regulating the pivoting angle of the bending tool 64, and a guide surface 49*b* of the guide member 49. The pivoting support point portion 64*c* is composed of a hole having a circular cross section. The supporting shaft 62, provided in the lower-bending tool driving member 26, is fitted into the pivoting support point portion 64*c* so as to rotationally move freely.

The sandwiching tool 28 has the detouring surface 28*d* between the guide surface 28*c* and the sandwiching surface 28*b*. The side of the sandwiching tool 28 which is opposite to its side facing the bending tool 64 is inclined and tapered downward. This results in the formation of a bending piece detouring space 66 to which a bending piece of the plate material W which is bent downward by the upper tool 21 is detoured. The sandwiching tool 28 has a base portion 28*e* arranged at its lower end and which is wider than its remaining part. The sandwiching tool 28 is removably fixed, at the base portion 28*e*, to the guide member 49 using fixtures b3 (FIG. 9) such as bolts. That is, the guide member 49 and the sandwiching tool 28 are integrated together.

Figure 11:
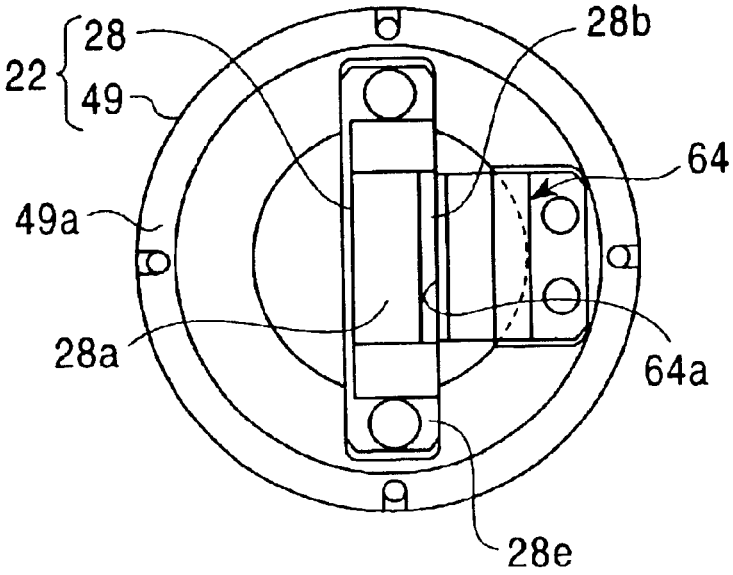
FIG. 11 is a plan view of a lower tool of this punch press.

The guide surface 49*b* of the guide member 49 is composed of a vertical surface portion 49*ba* parallel with the guide surface 28*c* of the sandwiching tool 28 and a ramp portion 49*bb* that approaches the sandwiching tool 28 as it extends upward from the upper end of the vertical surface portion 49*ba*. The guide member 49 is formed like a cylinder surrounding the sandwiching tool 28 and has the guide surface 49*b* formed at its top. Specifically, the guide surface 49*b* is formed on a guide piece 49A (FIG. 9) attached to the cylindrical guide member main body of the guide member 49 using fixtures b4 such as bolts. FIG. 11 is a plan view of the lower tool 22 showing how the lower tool-side bending tool 64 is attached.

The other arrangements of this embodiment are the same as those of the first embodiment. Description of the common points is omitted. The control device 70 in FIG. 7 is also provided in the plate material processing machine of this embodiment.

Figure 12B:
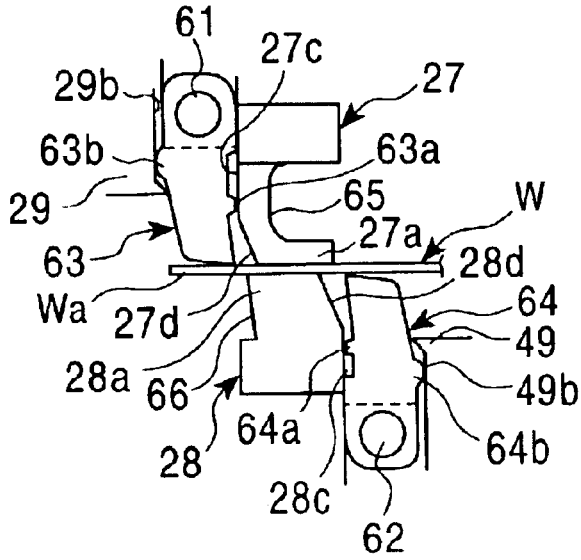
Figure 12C:
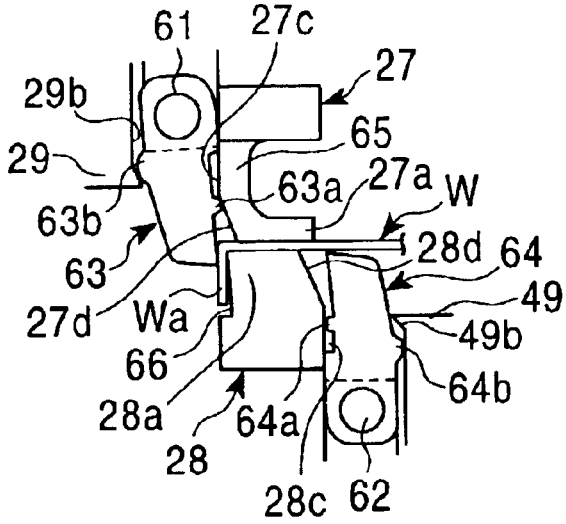
Figure 12D:
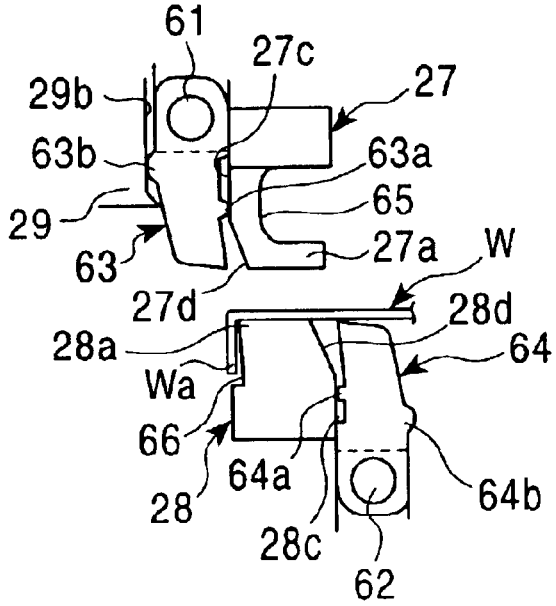
Figure 13A:
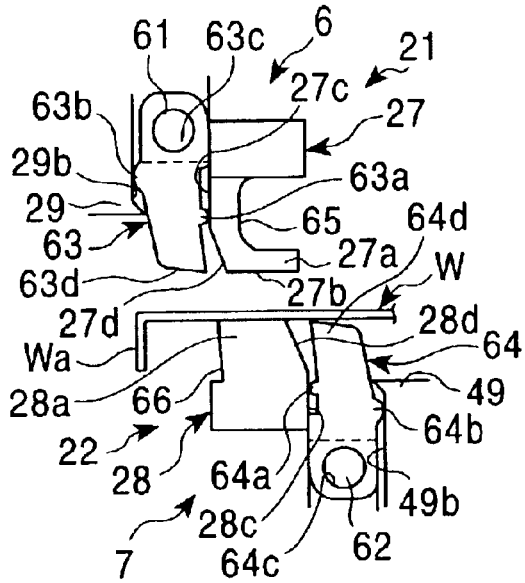
FIG. 13 is a diagram illustrating the latter half of the bending process using the punch press.
Figure 13B:
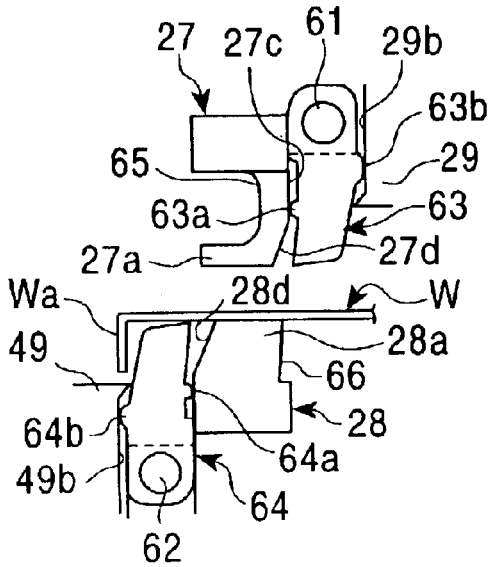
Figure 13C:
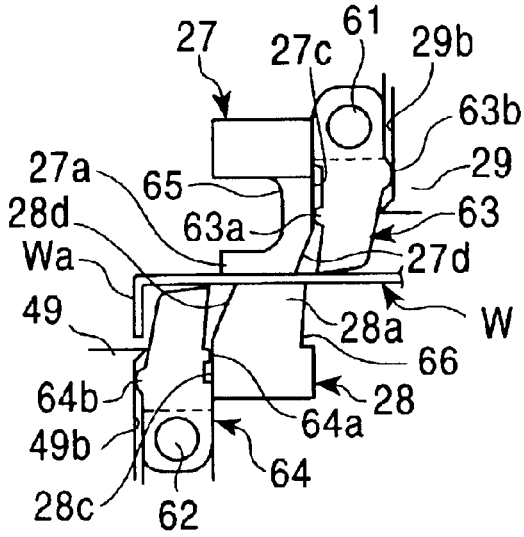
Figure 13D:
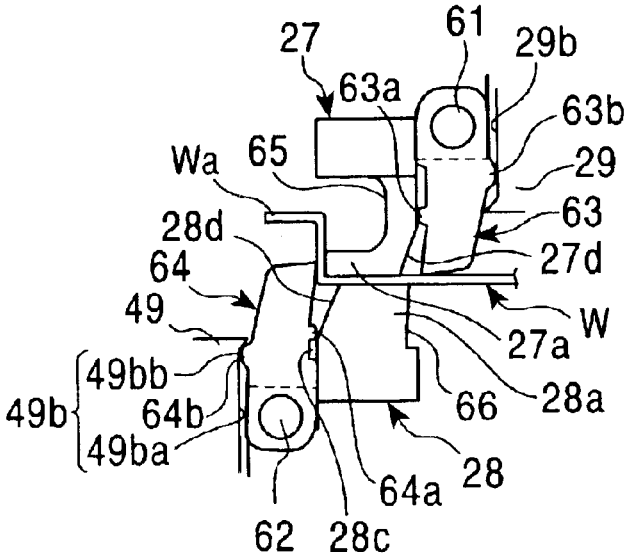

Now, with reference to FIGS. 12 and 13, description will be given of operations performed by the punch press of this embodiment to bend the plate material piece Wa projecting from the plate material W in two steps as shown in FIGS. 13D and 14B.

Before processing, as shown in FIG. 12A, in the lower tool 22 of the lower assembly tool 7, the sandwiching surface 28*b* as the top surface of the sandwiching tool 28 constitutes the plate material placement level. The lower tool-side bending tool 64 stands by slightly below the plate material placement level. That is, at this time, the ball 50, located at the lower end of the lower bending tool driving member (FIG. 9), rests on a flat surface located below the inclined surface portion 52*a* of the advancing and retreating member 52. The lower-bending tool driving member 26 has been lowered. Further, as shown in FIG. 12A, in the upper tool 21 of the upper assembly tool 6, the sandwiching surface 27*b* as the bottom surface of the sandwiching tool 27 has been retreated to a position slightly above the plate material placement level. At this time, the upper tool-side bending tool 63 has been retreated to a position above the sandwiching surface 27*b* of the sandwiching tool 27. In this state, the plate material feeding mechanism feeds the bending portion of the plate material W to the punch position P. That is, the plate material W is fed so that the plate material piece Wa of the plate material W projects beyond the sandwiching tool portion 28*a* of the sandwiching tool 28 to a side on which the upper tool-side bending tool 23 is positioned.

Then, the punch-side tool elevating and lowering means 9 drives and lowers the upper tool 21 together with the supporting member 38, engaged with the ram 8. As shown in FIG. 12B, the plate material W is sandwiched between the sandwiching tool portion 27*a* of the sandwiching tool 27 and the sandwiching tool portion 28*a* of the sandwiching tool 28.

As the punch-side tool elevating and lowering means 9 drives and lowers the upper-bending tool driving member 25 against the force of the presser spring 39. This descent causes the upper tool-side bending tool 63 to lower with the guide projections 63*a*, 63*b* on its opposite sides slidably contacting with the guide surface 27*c* of the sandwiching tool 27 and the vertical surface portion 29*ba* of the guide surface 29*b* of the guide member 29, respectively. Accordingly, the upper tool-side bending tool 63 lowers while maintaining its vertical position. Once the upper tool-side bending tool 63 has lowered to some degree, the regulation of angle of the upper tool-side bending tool 63, carried out by the sandwiching tool 27, is cleared when the guide projection 63*a* on one side of the upper tool-side bending tool 63 reaches the detouring surface 28*d* of the sandwiching tool 27 as shown in FIG. 12C. Further, the guide projection 63*a* on the other side of the upper tool-side bending tool 63 is guided along the ramp portion 29*bb* of guide surface 29*b* of the guide member 29 to lower the upper tool-side bending tool 63, which is simultaneously biased toward the sandwiching tool 27. That is, the bending tool 63, which has been lowering in its vertical position, is guided along the ramp portion 29*bb* to lower in such a way that its inclination around the supporting shaft 61 increases as it lowers.

This operation of the bending tool 63 bends, when the bending tool 63 is in its vertical position, the plate material piece Wa of the plate material W downward, which has been projected so as to face the upper tool-side bending tool 63. Subsequently, the bending tool 63 lowers while being inclined to increase the bending angle of the plate material piece Wa. Consequently, the plate material piece Wa is bent so as to form an acute angle. At this time, the plate material piece Wa is not hindered from being bent downward because of the bending piece detouring space 66, formed at one side of the sandwiching tool 28.

Subsequently, the punch-side tool elevating and lowering means 9 drives and elevates the upper tool 21 together with the supporting member 38, engaged with the ram 8. Then, the bottom surface of sandwiching tool portion 27*a* of the sandwiching tool 27 is retreated to a position slightly above the plate material W as shown in FIG. 12D.

Then, as shown in FIG. 13A, the plate material feeding mechanism 12 (FIG. 1) further feeds the plate material piece Wa of the plate material W to the side on which the upper tool-side bending tool 63 is positioned, by a predetermined amount. Then, the upper and lower assembly tools 6, 7 are rotated through 180 degrees. That is, the upper and lower tool holders 32, 33 are rotationally driven by the corresponding rotating mechanisms 41, 42. Thus, as shown in FIG. 13B, in the upper assembly tool 6, the upper tool-side bending tool 63 is placed at the right side of the sandwiching tool 27. On the other hand, in the lower assembly tool 7, the lower tool-side bending tool 64 is placed at the left side of the sandwiching tool 28.

Then, the punch-side tool elevating and lowering means 9 drives and lowers the upper tool 21 together with the supporting member 38, engaged with the ram 8. As shown in. FIG. 13C, the plate material W is sandwiched between the sandwiching tool portion 27*a* of the sandwiching tool 27 and the sandwiching tool portion 28*a* of the sandwiching tool 28.

Then, the die-side tool elevating and lowering means 51 carries out elevatory driving, i.e. the driving source 78 advances the advancing and retreating member 52. Thus, the ball 50, located at the lower end of the lower-bending tool driving member 26, runs onto the inclined surface portion 52*a* of the advancing and retreating member 52. The lower-bending tool driving member 26 elevates against the force of the presser spring 40. Thus, as shown in FIG. 13D, the guide projection 64*a* on one side of the lower tool-side bending tool 64 is released from the guide surface 28*c* of the sandwiching tool 28. On the other hand, the guide projection 64*b* on the other side of the lower tool-side bending tool 64 is guided along the ramp portion 49*bb* of the guide surface 49*b* of the guide member 49. Consequently, the lower tool-side bending tool 64 elevates while being biased toward the sandwiching tool 28. This operation bends the plate material piece Wa of the plate material W upward, which has been projected so as to face the lower tool-side bending tool 64. Subsequently, the bending angle of the plate material piece Wa is increased.

In this embodiment, various bending operations such as those shown in FIGS. 14A to 14D can be performed using a single set of dies as in the case with the above described embodiment.

Figure 15:
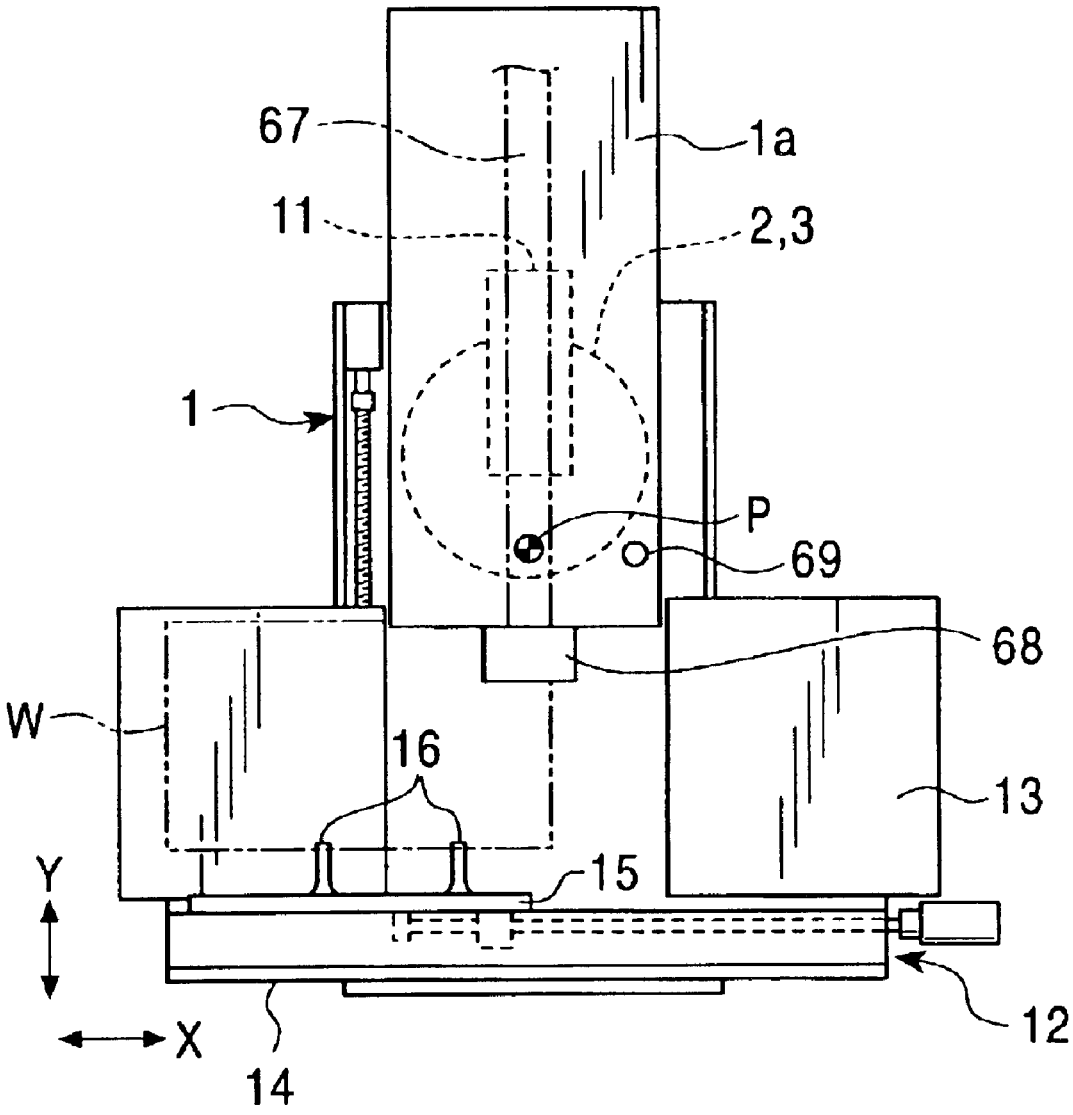
FIG. 15 is a plan view schematically showing a configuration of a plate material processing machine with a bending function according to yet another embodiment of the present invention.

In the description of the above described embodiments, the plate material processing machine is a punch press. However, the plate material processing machine of the present invention may be a laser processing machine having additional means for bending a plate material. In this case, only one set of assembly tools 6, 7 (see FIG. 3) for bending operations may be used or a plurality of such sets may be selectively used. Further, if the plate material processing machine is composed of such a laser processing machine with a bending function, a tap device may be added to it. In this case, a bottom hole for tapping is formed by laser processing, Furthermore, the plate material processing machine of the present invention is applicable to a composite processing machine having a combination of a punch press such as a turret punch press and a laser processing machine. For example, as shown in FIG. 15, a punch and laser composite processing machine may be used in which an irradiation head 68 for laser processing is added to the plate material processing machine according to the first embodiment. The irradiation head 68 is connected to a laser oscillator (not shown in the drawings) via a duct 67. In this case, this composite machine carries out punching, laser processing, tapping, and bending.

In the plate material processing machine with a bending function according to the present invention, the upper tool and lower tool that fix the plate material by sandwiching it between themselves are provided with the upper tool-side bending tool and the lower tool-side bending tool, respectively, so that the bending tools can elevate and lower freely. This enables both downward and upward bending to be accomplished and enables the production of a bending piece in L form or the like which has two or more bending portions. Further, by using the plate material feeding mechanism to adjust the feed rate, various bending operations with different bending dimensions can be performed using the same tools. If the strokes of the upper tool and lower tool-side bending tools can be adjusted, various bending operations with different bending angles can be performed using the same tools.

If the upper tool and the lower tool are rotatable around the common axis of rotation in the vertical direction, then it is possible to easily produce a bending piece in L form or the like which has two or more bending portions extending in different bending directions, without any such complicated movements of the plate material as change the direction of the plate material. Further, since the plate material piece can be sequentially bent upward and downward, it can be placed at a position above the die height. Consequently, the feeding of the bent plate material is not hindered.

If the upper tool and the lower tool are rotatable around the axis of rotation in the vertical direction, when the annular bending piece detouring space is formed between the sandwiching tool portion of the lower tool and the plate material supporting table portion, then the bending piece does not interfere with rotation of the tools.

The bending tool of the present invention has the pivoting support point portion arranged at one end, the bending edge arranged at the other end and pushed against the plate material, and the guide projections formed on one and the other sides of it in the direction in which it pivots around the pivoting support point portion, the guide projections contacting with the means for regulating the pivoting angle of the bending tool. Therefore, plate materials can be bent so as to form different bending angles or acute angles using the simple tool configuration.

The sandwiching tool of the present invention has the sandwiching surface contacting with the plate material, the guide surface separated from the sandwiching surface and arranged substantially perpendicularly to the sandwiching surface, and the detouring surface provided between the guide surface and the sandwiching surface and which is more concave than the guide surface. Therefore, the plate material can be bent so as to form an acute angle using the simple tool configuration.

What is claimed is:

1. A plate material processing machine with a bending function characterized by comprising an upper tool and a lower tool that fix a plate material at a plate material placement level so as to sandwich the plate material between the upper tool and the lower tool; a plate material feeding mechanism that feeds, at said plate material placement level, the plate material in a predetermined plate material feeding direction to project a plate material piece projecting from said plate material, from an edge of the upper tool or lower tool to a downstream side in said plate material feeding direction; an upper tool-side bending tool provided in said upper tool so as to elevate and lower freely and performing a lowering operation to bend a bending proximal end of said plate material piece downward; and a lower tool-side bending tool provided in said lower tool so as to elevate and lower freely and performing an elevating operation to bend a bending proximal end of said plate material piece upward.

2. A plate material processing machine with a bending function according to claim 1, characterized in that said upper tool and lower tool are rotatable around a common axis of rotation in a vertical direction, in that said upper tool-side bending tool and lower tool-side bending tool are arranged at sides of said upper tool and lower tool, respectively, and located opposite each other in the place material feeding direction relative to the upper tool and the lower tool, so as to be used for bending, and in that a bending piece detouring space is provided at a side of each of said upper tool and lower tool at which said upper tool-side bending tool or lower tool-side bending tool, respectively, is not arranged, so as to detour the bent place material piece to this space.

3. A plate material processing machine with a bending function according to claim 2, characterized in that said lower tool has a sandwiching tool portion having a top surface as a plate material sandwiching surface and a plate material supporting table portion having a top surface that substantially constitutes said plate material placement level, the plate material supporting table portion being separated from said sandwiching tool portion, and in that said lower tool-side bending piece detouring space is provided between the sandwiching tool portion and the plate material supporting table portion and is annular.

* * * * *